US006470638B1

(12) United States Patent
Larson

(10) Patent No.: US 6,470,638 B1
(45) Date of Patent: Oct. 29, 2002

(54) MOISTURE MANAGEMENT SYSTEM

(75) Inventor: John A. Larson, Parkland, FL (US)

(73) Assignee: Plastics Components, Inc., Miami, FL (US)

( * ) Notice: Subject to any disclaimer, the term of this patent is extended or adjusted under 35 U.S.C. 154(b) by 0 days.

(21) Appl. No.: 09/644,519

(22) Filed: Aug. 24, 2000

(51) Int. Cl.[7] ..... E04B 1/70

(52) U.S. Cl. ..... 52/302.1; 52/720.1; 52/94; 52/254

(58) Field of Search ..... 52/716.1, 716.2, 52/716.8, 302.3, 800.12, 94, 58

(56) References Cited

U.S. PATENT DOCUMENTS 3,735,540 A * 5/1973 Thaler ..... 52/94
5,946,870 A * 9/1999 Bifano et al. ..... 52/254
5,970,671 A * 10/1999 Bifano et al. ..... 52/254
6,119,429 A * 9/2000 Bifano et al. ..... 52/720.1

* cited by examiner

*Primary Examiner*—Carl D. Friedman
*Assistant Examiner*—Steve Varner

(57) ABSTRACT

An improved moisture management system for installation over doors and windows in buildings that included exterior, stucco-covered, curtain walls comprising an integrally formed, three sided, elongated track including a base, an upright front wall that includes at its base weep holes for the removal of entrained moisture as well as a longitudinal forward extending finish stop above the weep holes, and an upright rear wall at opposing elongated edges of the base, and, extending angularly downward from the outside of the base, and integrally formed therewith, a drip plate that permits ready drainage of water exiting the moisture management system through the weep holes in the upright front wall. Preferably, elongated striations in the front faces of both the front and rear upright walls as well as holes in the upright front wall above the finish stop provide improved adherence of sealants and adhesives used in the installation process.

6 Claims, 2 Drawing Sheets

MOISTURE MANAGEMENT SYSTEM

FIELD OF THE INVENTION

The present invention relates to moisture management systems for use over windows, doors and other building openings on buildings where so-called stucco covered, curtain type foamed siding is applied to the exterior of a building. Such moisture management systems inhibit the infiltration of water into the building at the top of such openings by providing a path for the potentially infiltrating water to take away from the surface of the building. The moisture management system described herein is also useful at the base of such exteriorly applied foamed siding to prevent water infiltration.

BACKGROUND OF THE INVENTION

The infiltration of water into buildings and other structures particularly at the top of windows, doors etc as well at the base of so-called stucco-covered, curtain type, foamed siding applied to the exterior of buildings is a constant problem in both new and retrofit construction.

The term curtain wall refers to a type of building construction in which an exterior non-load-bearing wall is supported in front of the structural frame like a curtain. Such wall structures, in some instances can be exposed to rain driven by winds; as high as 90 miles per hour in certain areas, and consequently are vulnerable to infiltration of wind driven rain as well as insufficient drainage of accumulated water from the area between the exterior curtain wall and the interior supporting shell of the wall construction.

Particularly vulnerable to infiltration of rainwater in this fashion are the areas over doors and windows and the lower extremity of the curtain wall where it meets the sill or foundation of the building.

The problem of infiltrated water can become critical where the wall area includes large window and or door openings and is often aggravated where water entering the wall cavity accumulates sufficiently to cause leakage into the interior of the building with resulting water damage. In some cases, water entering the wall cavity between the interior load bearing wall and the exterior curtain wall at window and door openings does not drain to the exterior of the building, but soaks through the wall portions causing structural damage and discoloration of the visible exterior portions of the wall.

Consequently, numerous designs have been proposed for moisture management systems and drip edges that either inhibit such infiltration and/or provide a means for conducting infiltrating water away from the opening in a safe and non-destructive manner.

U.S. Pat. No. 3,568,391 to Conway issued Mar. 9, 1971 describes a casing bead for stucco-covered curtain wall construction employing a joint including an elongate L-shaped casing bead and an elongate generally wing-shaped drainage cap member. The two joint components form a horizontally-disposed, structurally yielding joint between outer covering curtain wall sections that provides ventilation and water drainage between adjacent curtain wall panel sections.

U.S. Pat. No. 5,003,743 to Bifano et al, issued Apr. 2, 1991 describes another proposed track device for the installation of curtain wall type siding on structures that includes a flange arrangement designed to inhibit the infiltration of water, but no means to conduct infiltrated water away from the mounting device.

Thus, the provision of a satisfactory, simple and inexpensive moisture management system in curtail wall construction applications of the type just described, is and continues to be an elusive goal.

OBJECT OF THE INVENTION

It is therefore an object of the present invention to provide an improved moisture management system for installation over doors and windows on buildings utilizing a stucco-covered, curtain wall construction that demonstrates improved resistance to water infiltration, better drainage characteristics, increased simplicity and lower cost.

SUMMARY OF THE INVENTION

According to the present invention, there is provided an improved moisture management system for installation over doors and windows in buildings that included exterior, stucco-covered, curtain walls comprising an integrally formed, three sided, elongated track including a base, an upright front wall that includes at its base weep holes for the removal of entrained moisture as well as a longitudinal forward extending finish stop, and an upright rear wall at opposing elongated edges of the base, and, extending angularly downward from the outside of the base, and integrally formed therewith, a drip plate that permits ready drainage of water exiting the moisture management system through the weep holes in the upright front wall. Preferably, elongated striations in the front faces of both the front and rear upright walls as well as holes in the upright front wall above the finish stop provide improved adherence of sealants and adhesives used in the installation process.

DESCRIPTION OF THE INVENTION

The invention described herein is similar to that described in U.S. patent application Ser. No. 08/807,655 filed Feb. 27, 1997 which application is hereby referred to and incorporated by reference herein.

Figure 1:
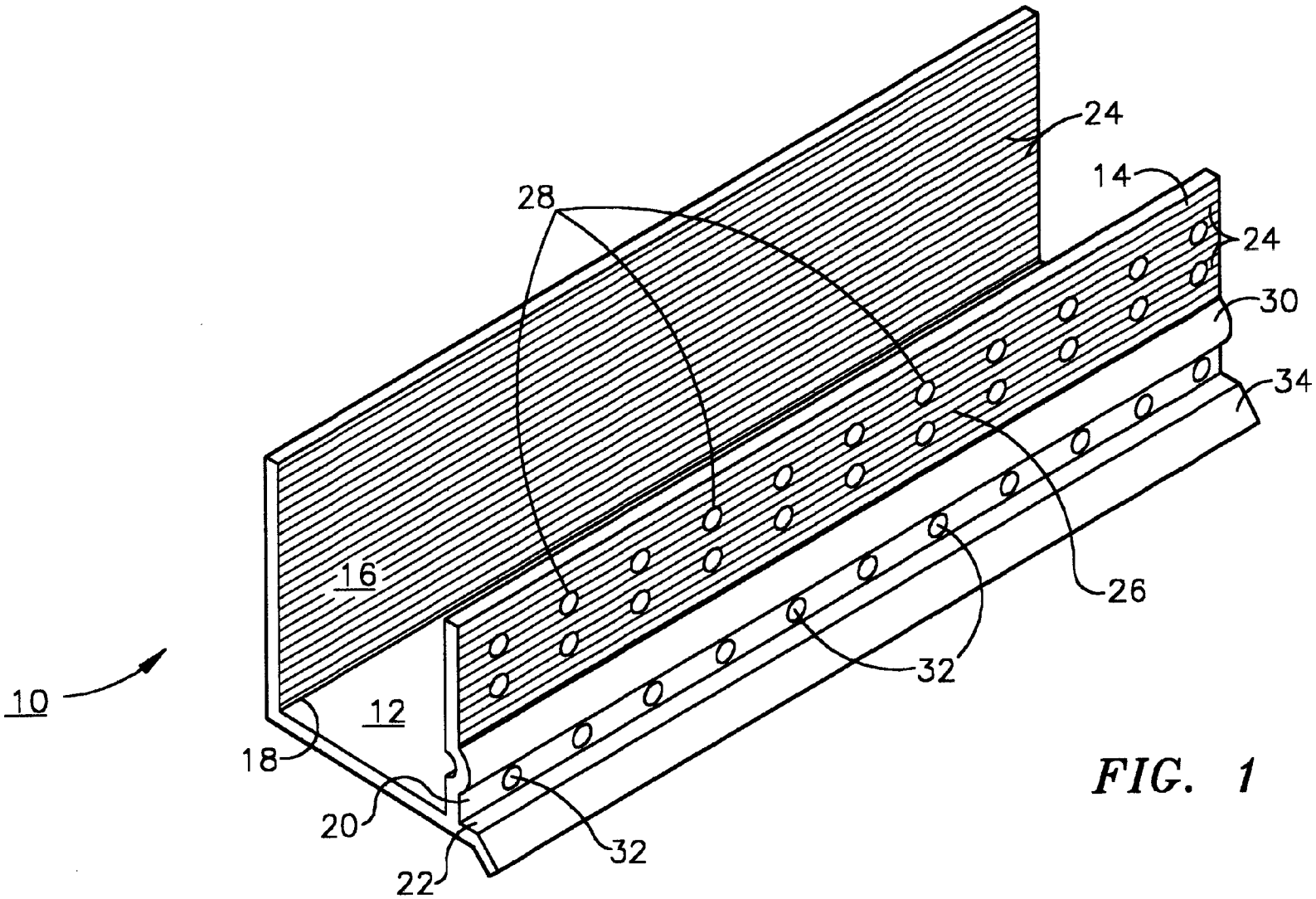
FIG. 1 is a perspective view of the improved moisture management system of the present invention.

As shown in FIG. 1, the moisture management system 10 of the present invention comprises an elongated, generally U-shaped, channel having a base 12, an upstanding front wall 14 and an upstanding rear wall 16 extending vertically, longitudinally and in generally parallel relationship from elongated edges 18 and 20 of base 12, and drip plate 22 integrally formed with base 12 and extending angularly therefrom. The front of both upstanding front wall 14 and rear wall 16 preferably include parallel striations 24 and 26 across their entire length. Front upstanding wall 14 further includes holes 28 therein. Upstanding front wall 14 additionally includes longitudinal finish stop 30 above weep holes 32, i.e. such that weep holes 32 lie between front elongated edge 20 and finish stop 30. The purpose and utility of these various features will be explained in greater detail below.

Figure 2:
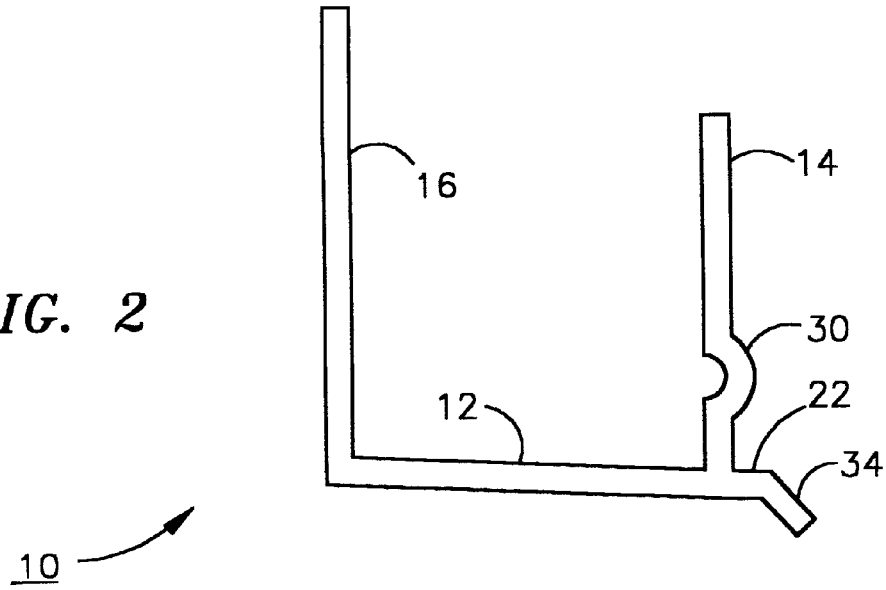
FIG. 2 is a cross-sectional view of the moisture management system of the present invention.
Figure 3:
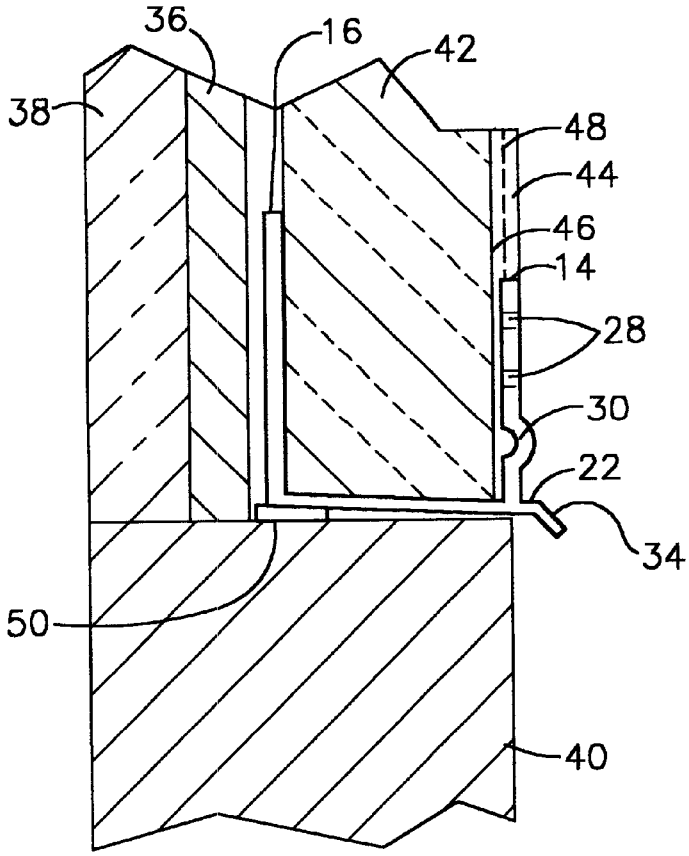
FIG. 3 is a cross-sectional of the moisture management system of the present invention in its installed configuration.

Drip plate 22 is integrally formed with base 12 and connected thereto along front elongated edge 20 and is formed in the extrusion process preferably used to fabricate moisture management system 10. Drip plate 24 is designed and manufactured to extend directly outward as an extension of base 12 or alternatively at a downward angle from base 12 so as to provide an enhanced pathway for removal of water that seeps through weep holes 32 that spaced along the entire length and at the base of front upstanding wall 14 above front elongated edge 20 and below finish stop 30. The first arrangement, with drip plate 22 extending downward is depicted in FIG. 2 while the second alternative embodiment with drip plate 22 extending directly outward as a 180° extension of base 12 is depicted in FIG. 3. An extension 34 of drip plate 22 extends downward and outward to further direct moisture draining out of weep holes 32 away from moisture management system 10 and consequently any underlying surface. No particular angle for drip plate 22 or extension 32 is critical to the successful practice of the present invention, so long as the structure is adequate to conduct moisture that has permeated into moisture management system 10 and exits weep holes 32 therefrom. Extension 34 of drip plate 22 extends beyond front edge 20 of upstanding front wall 14 and is preferably angled downward and outward from drip plate 22 to further assure positive removal of water escaping from weep holes 32 over drip plate 22.

Weep holes 32 are spaced at regular intervals along the lower edge of front upstanding wall 14 to provide a pathway for the drainage of water that has permeated the interior of moisture management system 10. It is preferred that weep holes 32 be of a slightly flattened or ovate shape as this appears to provide the most conducive structure for the best drainage.

Finish stop 30 comprises a raised outward facing longitudinal ridge in front upstanding wall 14 whose purpose is to inhibit the infiltration of finishing material applied over the face of front upstanding wall 14 during installation into weep holes 32 thereby resulting in their plugging and rendering them ineffective for the removal of moisture that has permeated moisture management system 10. The particular size and configuration of finish stop 30 is not of critical importance as long as this functionality is provided. A simplified such finish stop 30 comprises a "bead" or bulge in front upstanding wall 14 as shown in the appended drawings.

Holes 28 in front upstanding wall 14 are preferably present as providing locations for the permeation of over-applied finishing material, as described below, thereby further enhancing the adhesion of the finishing material to moisture management system 10.

Although moisture management system 10 may be fabricated from any number of materials and using a broad variety of fabrication processes, it is referred that moisture management system 10 be fabricated from a polymeric material such as PVC using an extrusion process for reasons of cost and simplicity of fabrication.

Installation of moisture management system 10 is accomplished as shown in FIG. 3. Rear upstanding wall 16 is nailed or otherwise attached to sheathing 36 attached to stud 38 over window 40. A section of backer rod and/or caulking 50 is inserted below base 12 in contact with the top of window 40 prior to nailing. Foam panel 42 is then inserted into the channel of moisture management system 10. Striations 28 provide for an enhanced firm and secure grip by moisture management system 10 on foam panel 42, when present. Modified cement or finishing material 44 is then placed over face 46 of foam panel 42 and, preferably, fiberglass mesh 48 embedded in finishing material 44. The presence of holes 28 in and striations 24 on front upstanding wall 16 permit finishing material 44 to penetrate front upstanding wall 16 and to adhere more effectively thereto thereby providing a more secure structure. Tape or some other protection is preferably applied over the face of weep holes 32 during the installation operation to insure that they do not become plugged by finishing material 44 that somehow bypasses finish stop 30 during the cementing and finishing operations.

There has thus been described a simple, easily manufactured yet highly effective moisture management system for the inhibition of moisture infiltration into and removal of any infiltrating moisture from curtain walled structures of the type described hereinabove.

As will be apparent to the skilled artisan, a number of variations and modifications can be made to the structure described above without departing from the spirit and scope of the present invention. All such modifications and changes are clearly contemplated as being within the scope of the appended claims.

What is claimed is:

1. An improved moisture management system for installation over doors and windows in buildings that included exterior curtain walls comprising:

A) an integrally formed, three sided, elongated channel including;
  I) a single thickness, solid base free of apertures;
  II) an upstanding front wall and an upstanding rear wall extending longitudinally along opposing elongated edges of the base; and
  III) a plurality of weep holes in said upstanding front wall adjacent said base;
  IV) a finish stop extending outwardly and longitudinally from the upstanding front wall above the plurality of weep holes; and
  V) a longitudinal drip plate extending from said base and beyond said upstanding front wall and integrally formed with said base.

2. The improved moisture management system of claim 1 wherein the upstanding front and rear walls each have a front face and including parallel longitudinal striations across the respective faces.

3. The improved moisture management system of claim 2 further including holes in said upstanding front wall above the finish stop.

4. The improved moisture management system of claim 2 further including holes in said upstanding front wall above the finish stop.

5. The improved moisture management system of claim 1 wherein the drip plate includes a tip portion, said tip portion extending angularly downward from said drip plate.

6. The improved moisture management system of claim 4 wherein the upstanding front and rear walls each have a front face and including parallel longitudinal striations across the respective faces.

* * * * *